United States Patent [19]

Husted

[11] 4,339,130

[45] Jul. 13, 1982

[54] GAME RACKET

[76] Inventor: Royce H. Husted, 711 Lakeside Dr., Wheaton, Ill. 60187

[21] Appl. No.: 124,571

[22] Filed: Feb. 25, 1980

Related U.S. Application Data

[63] Continuation-in-part of Ser. No. 16,522, Mar. 1, 1979, abandoned.

[51] Int. Cl.[3] ..... A63B 49/02; A63B 51/02

[52] U.S. Cl. ..... 273/73 R

[58] Field of Search ..... 273/67 R, 67 B, 73 R, 273/73 C, 73 D, 73 E, 73 L, 76, 326

[56] References Cited

U.S. PATENT DOCUMENTS

| | | | |
|---|---|---|---|
| D. 250,134 | 10/1978 | Baumgartner | 273/73 D X |
| 2,969,984 | 1/1961 | Presnick | 273/73 R |
| 3,507,494 | 4/1970 | Finkel | 273/67 R |
| 3,822,062 | 7/1974 | Tucker et al. | 273/326 |
| 3,934,876 | 1/1976 | Haddad | 273/73 C |
| 4,026,553 | 5/1977 | Vendramini | 273/73 D X |
| 4,079,935 | 3/1978 | Gormley | 273/67 R |
| 4,095,790 | 6/1978 | Swiecicki | 273/73 E X |
| 4,185,822 | 1/1980 | Li | 273/73 C |

FOREIGN PATENT DOCUMENTS

| | | | |
|---|---|---|---|
| 1051701 | 2/1959 | Fed. Rep. of Germany | 273/73 C |
| 981444 | 1/1951 | France | 273/73 D |
| 1503812 | 10/1967 | France | 273/73 C |
| 3127 | of 1885 | United Kingdom | 273/73 D |

*Primary Examiner*—Richard J. Apley
*Attorney, Agent, or Firm*—Samuel Shiber

[57] ABSTRACT

A game racket having an elastic net and a frame molded in unison, the net comprising non-linear elements which work primarily in bending and whose cross sectional area increases toward the center of the net.

3 Claims, 5 Drawing Figures

GAME RACKET

BACKGROUND AND SUMMARY OF THE INVENTION

This application is a continuation in part of my copending application Ser. No. 16,522 filed on Mar. 1, 1979, abandoned, and is related to Ser. No. 124,572, filed concurrently.

The present invention relates to a molded game racket.

Game rackets can be divided into two groups: A first group containing rackets which have little or practically no recoil system such as, for example, rackets made of a wood piece, where the recoiling action depends mostly on the ball's elasticity. An example to such a stiff racket can also be found in U.S. Pat. Nos. 3,934,876 and 3,879,035 by Haddad and by Dan Chulis, respectively, or in most ping pong rackets.

A second group contain rackets with a recoiling mechanism, commonly in the form of an elastic net. Present rackets of this second group are commonly produced by forming a separate frame on which tensioned strings are strung. This process, while producing an acceptable racket is costly and introduces some inherent drawbacks into the final product. For example, strings with aerodynamic cross-sections cannot be utilized in spite of their obvious advantage in minimizing the drag, i.e., the air's resistance to the racket's fast movement. Further, the strings inherent uniformity prevents some desirable localized modification, and further, since the strings are not interlocked at their criss-cross junctions, and rely primarily on friction to hold their arrangement on the frame, every time the ball is hit by the racket the strings tend to mutually abrade especially in the looser string rackets such as for racquet ball game. This friction and abrasion between the strings dampens the recoil action of the net reducing its effectiveness. In addition, the minute residual relative displacement of the strings tends to accumulate and to create over-tension in the lower area of the net (close to the handle) and looseness in the most important "sweet spot" area, destroying the racket's performance while structurally stressing the frame.

The present invention provides a molded racket which circumvents the above shortcomings and at the same time it is less costly to manufacture.

At this point some discussion and comparison of the present invention with a conventional, string racket may be helpful. When a ball hits a net of a conventional racket the net absorbs some of the ball's kinetic energy by its strings, becoming tensioned and bent simultaneously; and as the strings return to their untensioned position, some of this energy is returned to the recoiling ball. However, the contribution of the strings unbending is so small that it can be ignored.

In the present invention the bending and consequent unbending of the net elements is a major factor in the ball/racket recoiling mechanism, and in some embodiments of the present invention the tension in the net's elements is purposely reduced and converted by a certain geometry to bending. Some of the reasons for such preference are that such a geometry permits the net to store more energy without over-stressing its elastic elements; and that, in a molding process, controlling the net's geometry is relatively simple, whereas controlling the tension in molded strings presents quality control problems.

However, a molded racket has some unique problems, such as the net being very stiff and brittle in the area at which it connects to the frame, and a sharply declining spring rate toward the center. The present invention overcomes the problem of the peripheral net stiffness by employing a net structure (the term "net structure" means the net, viewed by itself, as if it was independent from the remaining racket's structure) which has a sharply increasing stiffness, or spring rate, toward its center, so that when it is the net portion of the racket (the term "net portion" means the net when it is an integrally molded part of the racket) its ball recoiling characteristics are evened.

The present invention overcomes the peripheral brittleness problem by having hinge means at the point that the frame and the net connect one to the other. This hinge means can be formed by locally reducing the thickness of the net's elastic elements (and increasing their width to maintain their tensile strength) or by forming a pronounced bend, as will be illustrated in the foregoing discussion.

DETAILED DESCRIPTION OF THE DRAWINGS

Figure 1:
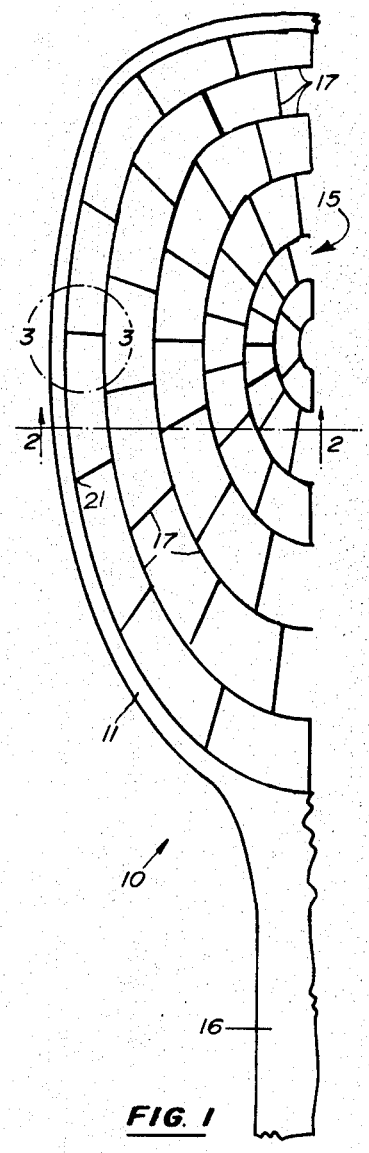
FIG. 1 shows a one half of a first embodiment of the present invention.
Figure 3:
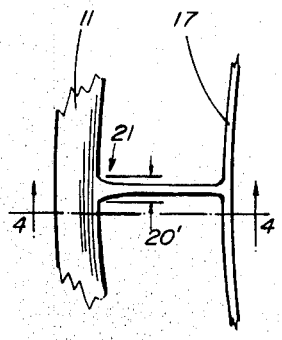
FIG. 3 shows an enlarged section of FIG. 1 which is encircled by a phantom line 3—3 marked on FIG. 1.
Figure 4:
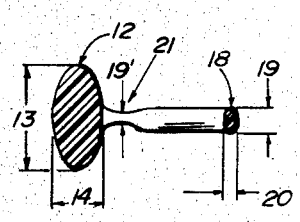
FIG. 4 shows a cross section of FIG. 3 as viewed along line 4—4 marked on FIG. 3.

FIGS. 1, 2, 3, and 4 show a molded game racket 10 comprising a frame 11 having a first cross-section 12 with a first thickness 13 and a first width 14. An elastic net 15 is molded in unison with the frame 11 and a handle 16. The net comprises a plurality of elastic members 17 each having a second cross section 18 with a second thickness 19 and a second width 20 which are substantially smaller than the first thickness and the first width, respectively.

The stiffness of the net 15 itself, when it is viewed by itself and not as a part of the racket 10, increases toward its center, so that, when it is integral with the frame 11 the recoil effect of a ball off various parts of the net is evened.

Figure 5:
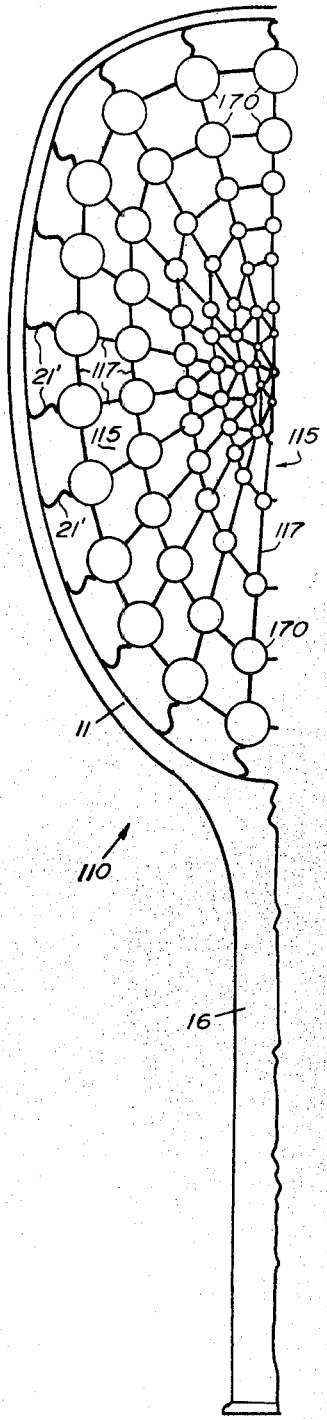
FIG. 5 shows a one half of a second embodiment of the present invention having a different net pattern.
Figure 2:
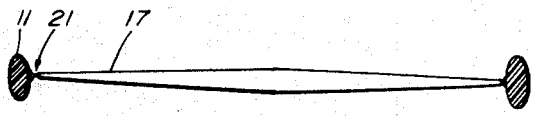
FIG. 2 shows a cross section of the first embodiment as viewed along line 2—2 marked on FIG. 1.

To increase stiffness of the net structure in the center various methods can be employed, for example, the net can be made denser toward the center and/or thicker. The denser net configuration is illustrated in FIGS. 1 and 5, and the thickening of the elastic members 17 toward the center of the net is illustrated in FIG. 2 in conjunction with the first embodiment.

The reason that the net periphery tends to act stiffer when made an integral part of the racket 10 is that the elastic elements 17 connecting to the frame act as cantilevered members. In order to minimize this phenomena and in order to minimize the net's brittleness in the area at which it connects to the frame 11, the net 15 is connected through hinge means 21 to the frame 11. Such hinge means 21 are an integral part of the molded frame 11 and net 15 and the hinge effect is achieved due to local geometry modifications. In the first embodiment this is done by reducing the second thickness 19' and increasing the second width 20' in order to minimize the above discussed cantilever effect while maintaining the net's tensile strength, and in the second embodiment the hinge means is provided by strongly curving the elastic element 21'.

The net in both embodiments is formed of non-linear (the term "non-linear" as used herein means that the elastic elements do not form a straight line between hinge points 21, or 21' but intermittently and abruptly change direction at a plurality of intersections, or junction points along the way, in contrast to conventional racket's strings, which do) elastic elements since this configuration reduces the tension and increases the bending of the elastic elements 17 as a result of a ball hitting the net 15. This bias of developing bending stresses in the net instead of the conventional tension is preferable, in a molded racket, since tension, and pretension, in a molded racket is hard to control uniformly from one racket to another, and in various parts of the net 15, whereas the bending characteristics are dictated by the racket's geometry and therefore are easily controllable in a molded racket. The non-linearity of the elastic elements, as illustrated in FIGS. 1 and 5 prevents substantial tension from developing in the elastic elements 17.

The second embodiment 110 has similar characteristics as the first embodiment although its specific construction is somewhat different: The net 115 is made of straight and rounded elastic members 117 and 170 respectively and hinge means 21' are different from those of the first embodiment as previously discussed.

Although the present invention was illustrated with a limited number of embodiments it is understood that various modifications and substitutions can be made without departing from the spirit of the invention or the scope of the claims.

I claim:

1. In a molded game racket comprising, in combination, (a) a handle, (b) a frame, having a frame cross-section with a frame thickness and a frame width, and (c) an elastic net molded in unison with at least said frame, said net comprising a plurality of elastic elements integrally connected to said frame, each such element having an element cross-section with an element thickness and an element width, said element width being substantially smaller than said frame width, wherein the improvement comprises: said elements having a progressively increasing thickness from the frame towards the center of said net so as to provide a higher stiffness or spring rate thereat when said net is considered independent of said frame, the end portions of said elastic elements being cantilevered from said frame so as to stiffen the periphery of said net thereby resulting in a net with a more uniform stiffness so that the recoil effect of a ball bouncing off the various parts of said net is evened.

2. A racket as in claim 1 wherein said end portions are configured to provide a hinge effect thereto.

3. A racket as in claim 1 wherein said elements extend from the frame toward the center in a non-linear configuration so as to reduce the tension and increase the bending stresses in said elements upon ball impacts.

* * * * *